US008398427B2

(12) United States Patent
Wu

(10) Patent No.: US 8,398,427 B2
(45) Date of Patent: Mar. 19, 2013

(54) USB PLUG CABLE ASSEMBLY

(75) Inventor: Jerry Wu, Irvine, CA (US)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/212,199

(22) Filed: Aug. 18, 2011

(65) Prior Publication Data

US 2012/0045934 A1 Feb. 23, 2012

(30) Foreign Application Priority Data

Aug. 18, 2010 (CN) ..... 2010 1 0256382

(51) Int. Cl.
*H01R 3/00* (2006.01)

(52) U.S. Cl. ..... 439/497

(58) Field of Classification Search ..... 439/497, 439/494, 579, 607.41, 607.45, 607.46, 607.47, 439/607.48, 607.49, 607.24, 607.01
See application file for complete search history.

(56) References Cited

U.S. PATENT DOCUMENTS 7,422,488 B1 * 9/2008 Wu ..... 439/676
2009/0117784 A1 * 5/2009 Wu ..... 439/660

* cited by examiner

*Primary Examiner* — Edwin A. Leon
*Assistant Examiner* — Harshad Patel
(74) *Attorney, Agent, or Firm* — Wei Te Chung; Ming Chieh Chang

(57) ABSTRACT

A cable assembly (100), comprises: a plurality of first contacts (2), an insulative housing (1) molding outside the first contacts (2), a plurality of second contacts (3) received in the housing (1), a flat cable (4) connecting with the first contacts (2) and the second contacts (3), and the cable (4) comprising a plurality of inner conductors (40) arranged on upper and lower row, the upper row of the inner conductors (40) soldered to the second contacts (3) and the lower row of the inner conductors (40) soldered to the first contacts (2), a metallic shell (5) shielding outside the insulative housing (1).

15 Claims, 7 Drawing Sheets

USB PLUG CABLE ASSEMBLY

FIELD OF THE INVENTION

The present invention generally relates to a USB plug cable assembly, and more particularly to a USB plug cable assembly with an improved shell.

DESCRIPTION OF RELATED ART

Universal Serial Bus (USB) is a serial bus standard to the PC architecture with a focus on computer telephony interface, consumer and productivity applications. The interface design of USB is standardized by the USB Implementers Forum (USB-IF), an industry standardized organization founded by computer and communication companies. And USB cables used to connect peripherals such as mouse devices, keyboards, PDAs, gametabs and joysticks, scanners, digital cameras, printers, external storage, networking components, etc. For many devices such as scanners and digital cameras, USB has become the standard connection method.

Taiwan Patent Publication No. 357095 discloses a USB 3.0 connector assembly. The previous USB plug has a round cable and a metallic shell enclosing the cable, so the USB plug has a high profile. Thus, the tradition USB plug can not meet the miniaturization developing trend.

Correspondingly, it is desired to have a cable assembly with improved structure to address the problems stated above.

BRIEF SUMMARY OF THE INVENTION

Accordingly, an object of the present invention is to provide a cable assembly with low profile.

In order to achieve the above-mentioned object, A cable assembly, comprising: a plurality of first contacts, an insulative housing molding outside the first contacts, a plurality of second contacts received in the housing, a flat cable connecting with the first contacts and the second contacts, and the cable comprising a plurality of inner conductors arranged on upper and lower row, the upper row of the inner conductors soldered to the second contacts and the lower row of the inner conductors soldered to the first contacts, a metallic shell shielding outside the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
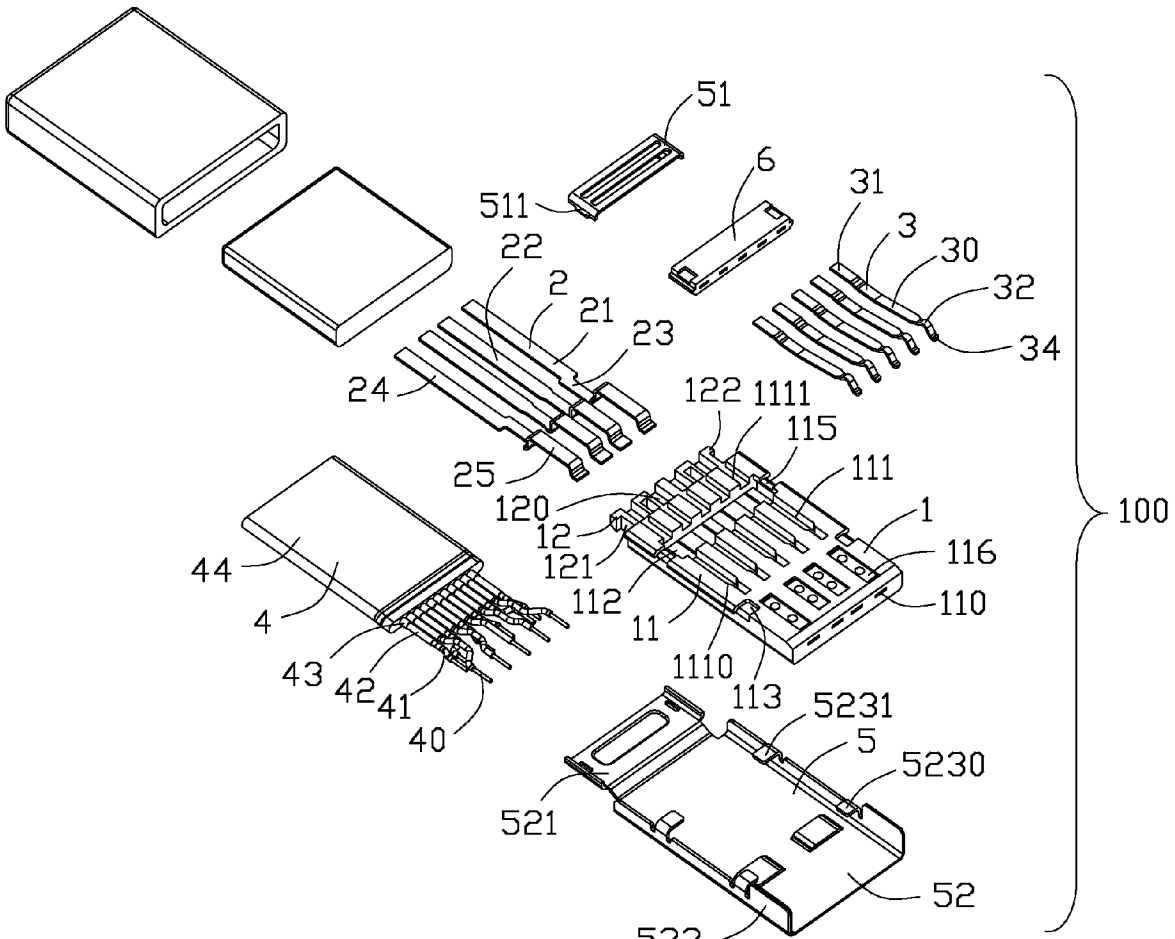
FIG. 1 is an exploded, perspective view of a cable assembly in accordance with the present invention.

Reference will now be made to the drawing figures to describe the present invention in detail.

Figure 2:
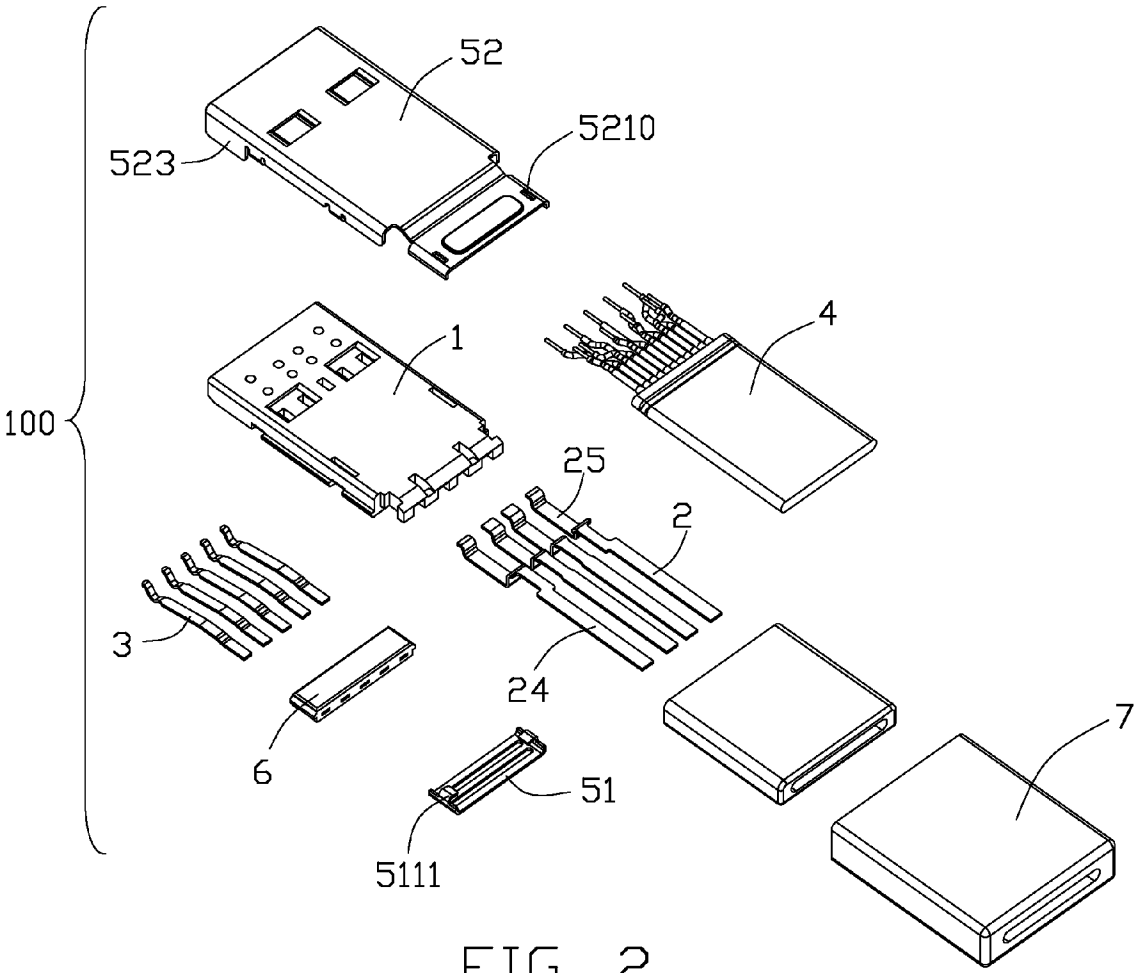
FIG. 2 is similar to FIG. 1, but viewed from another aspect.

Referring to FIGS. 1 to 2, a cable assembly 100 in accordance with the present invention is according with the USB 3.0 standard, and the cable assembly 100 comprises a plurality of first contacts 2, an insulative housing 1 molding outside the contacts 1, a plurality of second contacts 3 received in the insulative housing 1, cable 4 connecting with the first contacts 2 and the second contacts 3, and a metallic shell 5 shielding outside the insulative housing 1.

Referring to FIGS. 1 to 2, the insulative housing 1 comprise a base portion 11 and a tongue portion 12 extending rearward from the base portion 11. A plurality of terminal receiving passages 110 are defined in the base portion 11 and extend along a mating direction of the cable assembly 100. A plurality of terminal receiving grooves 111 formed in an upper surface of the base portion 11 for receiving the second contacts 3. A step-shaped portion 114 is formed in the lower section of the front surface of the terminal receiving grooves 111 and extended forwardly and downwardly. And in this way, the terminal receiving grooves 111 are connected with the terminal receiving passages 110 along the perpendicular direction. The transverse surface of the step-shaped portion 114 defines a bottom wall 1113. A groove 112 is recessed downwardly from the upper surface of the insulative housing 1 to divide the terminal receiving grooves 111 into a front section and a back section, and the front section defines a plurality of first receiving grooves 1110, and the back section defines a plurality of second receiving grooves 1111. A plurality of grooves 116 downwardly extends from the upper surface of the front end portion of the base portion of the housing 1. A pair of cutouts 115 are respectively formed on the two outer wall of the front section of the housing 1 and adjacent to the back section. A plurality of supporting grooves 120 formed in an upper surface of the tongue portion 12 and the supporting grooves 120 are respectively in alignment with the terminal receiving passages 110 along a front-to-back direction. Two locking holes 113 are recessed downwardly from the two side walls of the upper surface of the base portion 11 and located between the front end portion and the front section of the housing 1. A pair of bumps 122 are formed in the two lateral walls 121 of the tongue portion 12 and extending outwardly.

Referring to FIGS. 1 to 2, the number of the first contacts 2 is four, and two outside first contacts are defined as power contacts 21, and two inside first contacts are defined as signal contacts 22. Each contact 2 comprises a retention portion 23 and a tail portion 24 extending backwardly from the retention portion 20 and a mating portion 25 extending upwardly and forwardly from the retention portion 23. The tail portion 24 is beyond the back surface of the base portion 11 and the mating portion 25 is exposed on the upper surface of the insulative housing 1. The mating portions 25 are received in the terminal receiving passages 110 and the upper surface of the mating portions 25 are exposed in the grooves 116. The retention portions 23 are received in the terminal receiving passages 110, and the tail portions 24 are supported in the supporting grooves 120.

Referring to FIGS. 1 to 2, the number of the second contacts 3 are five, and each second contact 2 comprises a base portion 30, a tail portion 31 extending rearwardly from the base portion 30 and a mating portion 32 extending forwardly from the base portion 32. The mating portions 32 are exposed on the upper surface of the insulative housing 1, and the mating portions 32 are installed behind the mating portions 25. And a tail end 34 is formed in the end of the mating portion 32 and extending forwardly.

Referring to FIGS. 1 to 2, the cable assembly 100 also comprises a spacer or insulator 6, and the spacer 6 molding outside the back-section of the base portion 30 of the second contacts 3.

Referring to FIGS. 1 to 2, the cable 4 comprises a plurality of wires, each wire comprises an inner conductor 40, an inner insulative layer 41 enclosing the inner conductor 40, a braiding layer 42 enclosing the inner insulative layer 41 and an outer insulative layer 43 enclosing the braiding layer 42. Besides, the cable 4 also comprises an insulative jacket 44 enclosing the wires. Please referring to FIGS. 1 to 2, the inner conductor 40 is exposed from the front edge of the inner insulative layer 41, the insulative layer 41 is exposed from the front edge of the braiding layer 42 and the braiding layer 42 is exposed from the front edge of the outer insulative layer 43, and all of the outer isolative layers 43 are exposed from the front edge of the insulative jacket 44 together. The cable assembly 100 of the present invention, the wires connecting with the first contacts 2 are departed from the wires connecting with the second contacts 3. The number of the inner conductors 40 connecting with the first contacts 2 is six and the inner conductors 40 arranged in a lower row. And the number of the inner conductors 40 connecting with the second contacts 3 is five and the the inner conductors 40 arranged in an upper row. Please referring to the FIGS. 1 to 2 and in conjunction with FIGS. 3 to 4, the connecting method between the first contacts 2 and the second contacts 3 with the cable 4 of the present cable assembly 100 are as described: one of the upper row inner conductors 40 is connected with a second contact 3, the lateral two inner conductors 40 of the lower inner conductors 40 are connected with a power contact 21 at the same time, and one of the lower inner conductors 40 is connected with a signal contact 22.

Figure 3:
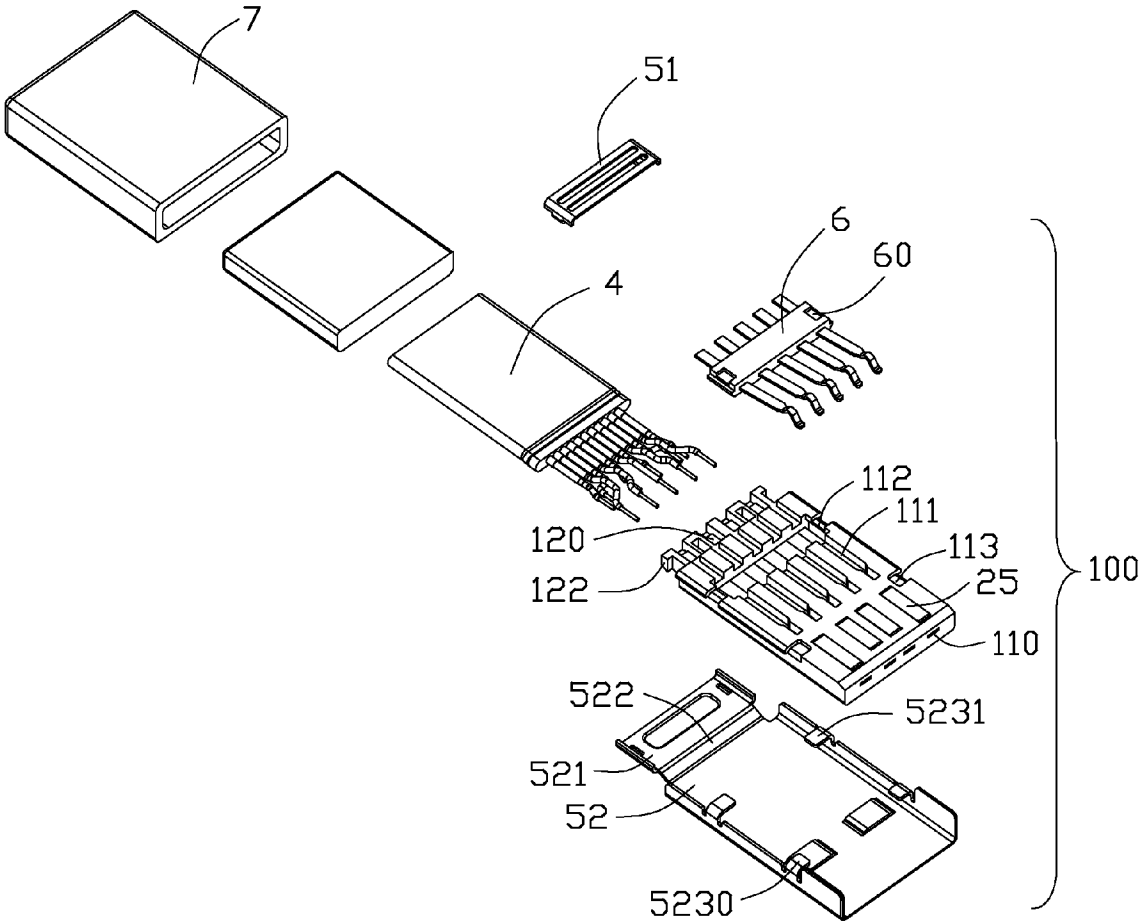
FIG. 3 is a perspective, partial assembled view of the cable assembly of FIG. 1.
Figure 4:
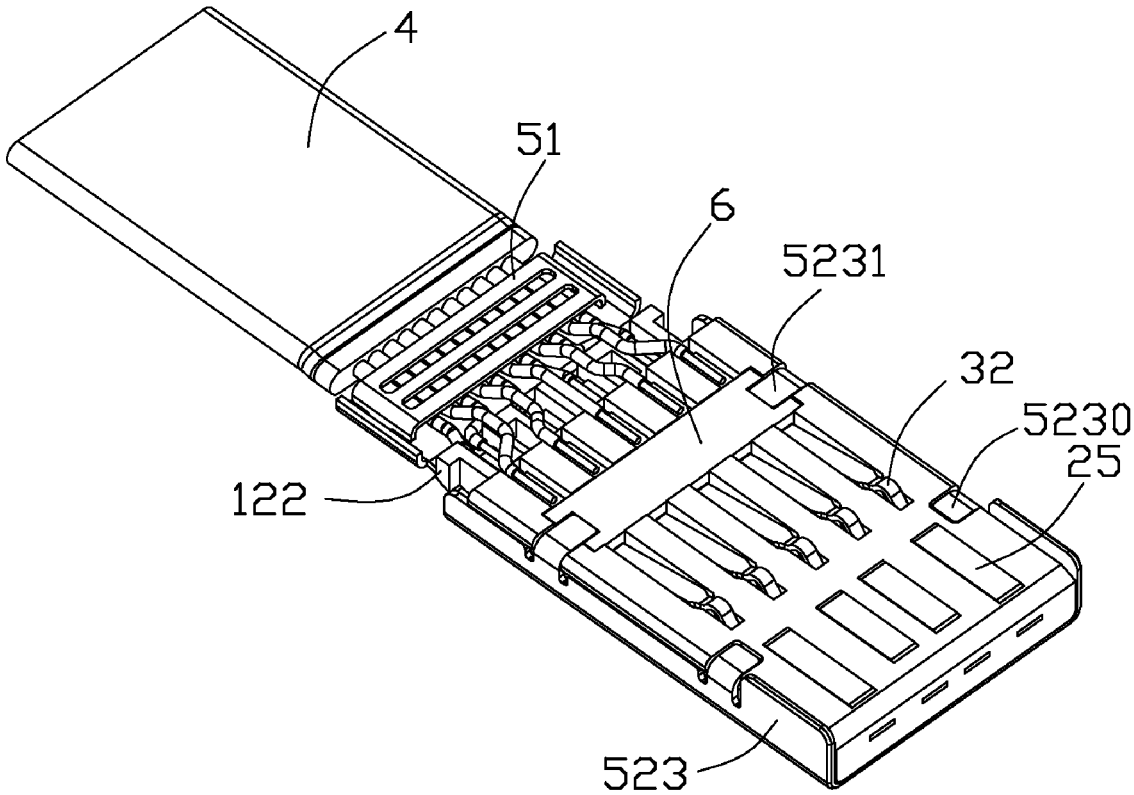
FIG. 4 is a perspective, other partial assembled view of the cable assembly of FIG. 1.
Figure 5:
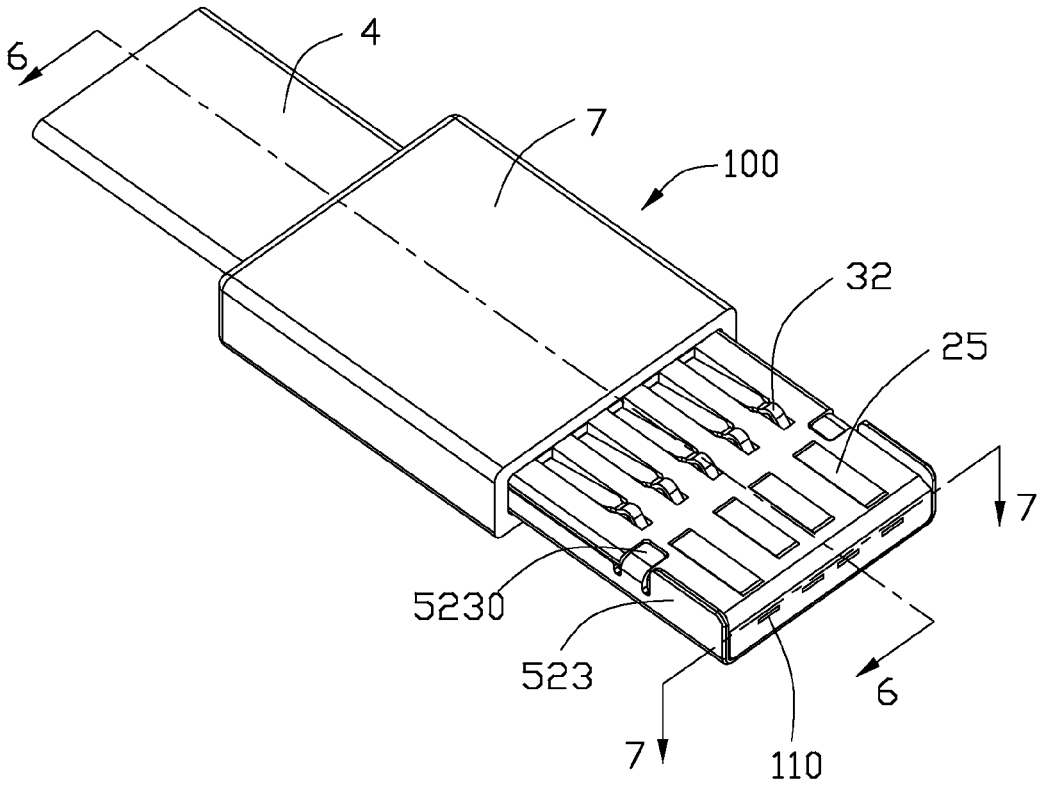
FIG. 5 is an assembly, perspective view of the cable assembly of FIG. 1.
Figure 6:
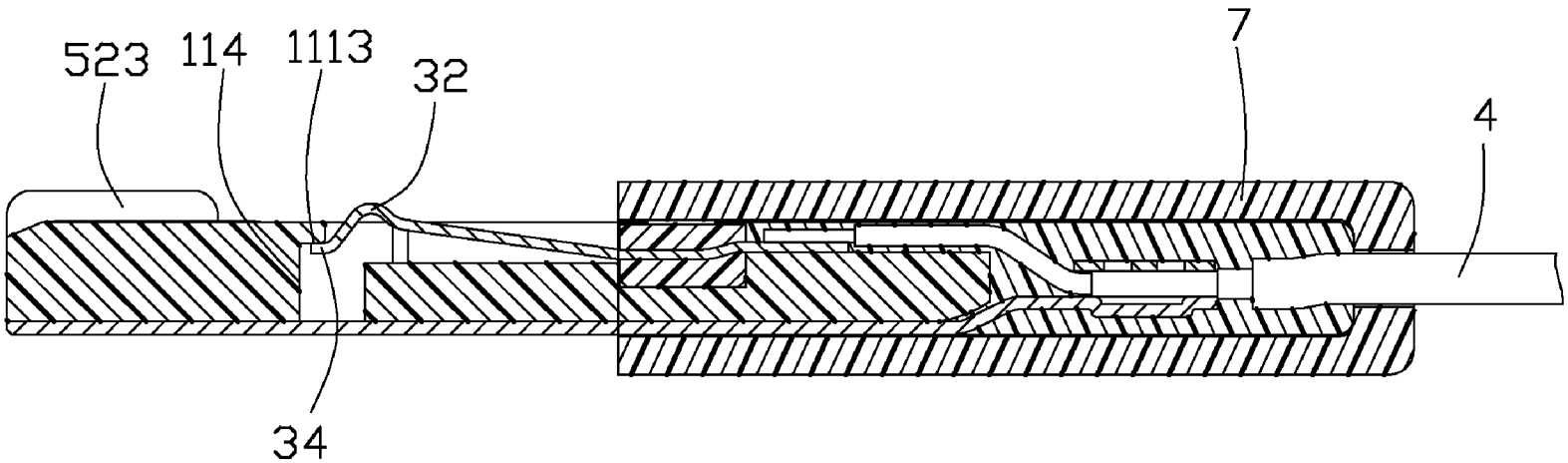
FIG. 6 is a cross-sectional view of the cable assembly taken along line 6-6 of FIG. 5.
Figure 7:
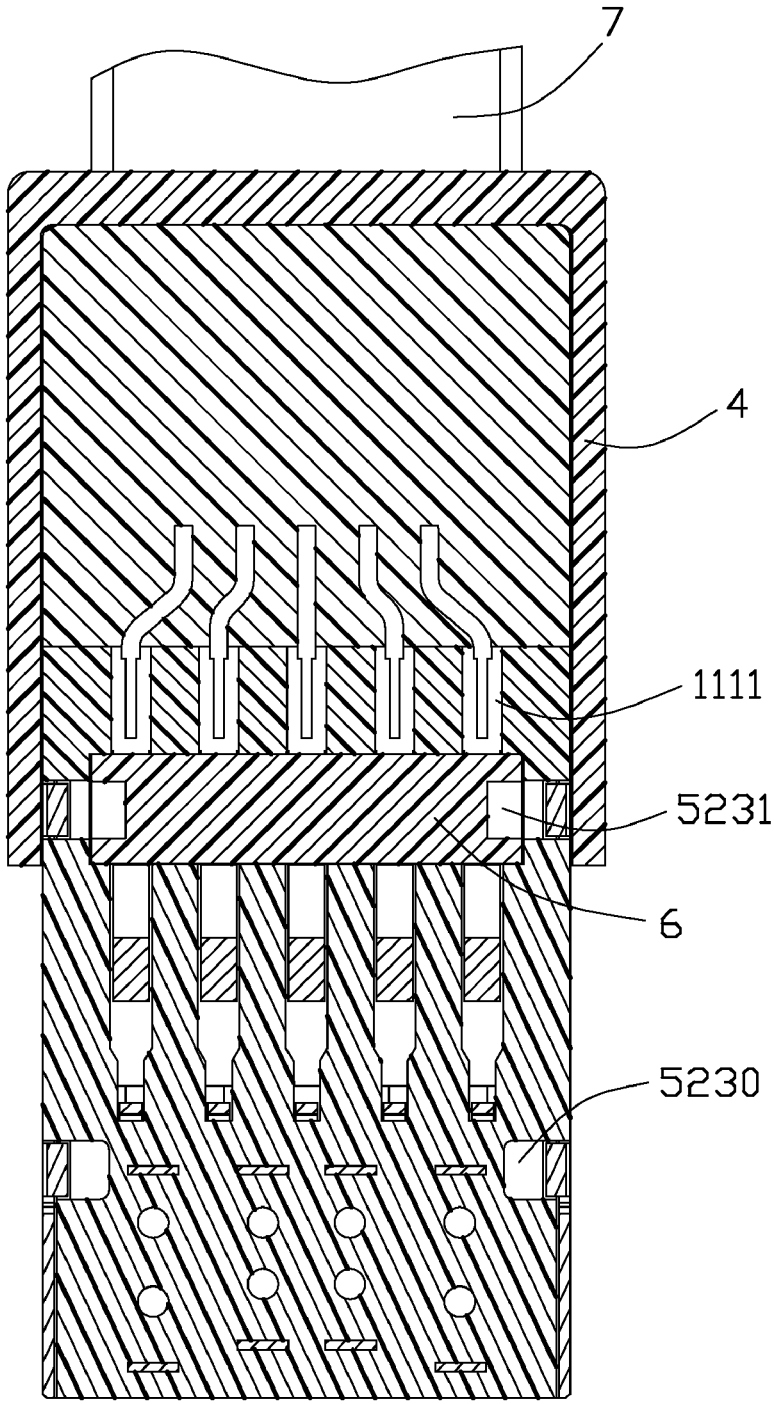
FIG. 7 is a cross-sectional view of the cable assembly taken along line 7-7 of FIG. 5.

Referring to FIGS. 1 to 2 and in conjunction with FIGS. 3 to 4, the cable assembly 100 of this invention defines a method of the connection between the first contacts 2, the second contacts 3 and the cable 4. The inner conductors 40 located on the upper row are respectively connected to the second contact 3, the inner conductors 40 located on the lower row have two contacts on the two side thereof connected to the power contacts 21, and two other contacts among the two above thereof connected to the signal contacts 22.

The metallic shell 5 comprises a top shell 51 covered on a part of cable 4, a bottom shell 52 covering the lower surface of the housing and a pair of side walls 523 upward extending from the bottom shell 52. Each one of the two side walls 523 comprises a first fastening tab 5230 and a second fastening tab 5231 respectively inward extending from the side wall 523 and respectively corresponding to the locking hole 113 and the cutout 115. The part of the side wall 523 behind the first fastening tab 5230 is lower than the part of the side wall 523 in front of the first fastening tab 5230. Thus, the side wall 523 is composed by a lower portion and a higher portion. When the metallic shell 5 is assembled on the housing 1, the lower portion is lower than the upper surface of the housing 1 and the higher portion exceeds the upper surface of the housing 1 to be exposed out of the cable assembly 100. The metallic shell 5 further comprises a supporting portion 521 located on the rear portion of the bottom shell 52 for supporting the braiding layer 42, and a connecting portion 522 connecting the supporting portion 521 to the bottom shell 52 for supporting the tongue portion 12. The supporting portion 521 has a pair of slots 5210 extending through the upper and lower surfaces of the supporting portion 521 and located on the two sides of the lower surface thereof. The top shell 51 has a pair of side walls 511 on the two sides thereof. A pair of tabs 5111 is respectively inward bended from the side walls 511 to correspond to the two slots 5210 of the bottom shell 52.

In assembled with the cable assembly 100, the contacts 2 are received in the insulative housing 1 via the insert-molding process, the contacts 2 are received in the terminal receiving passages 110 and the tail portion 22 of the contacts 2 are received in the terminal receiving grooves 120; and the spacer 6 molding outside the second contacts 3 and assembling onto the upper surface of the insulative housing 1, the mating portions 32 and the front edge of the base portions 30 are received in the first receiving grooves 1110, and the tail portions 31 of the second contacts 3 are received in the second receiving grooves 1111, and the tail ends 34 of the second contacts 3 are received into the front edge of the first receiving grooves 1110 and closed with the bottom surface of the bottom wall 1113; the spacer 6 is disposed in the grooves 112; then the bottom shell 52 is assembled in the bottom surface of the insulative housing 1, the first fastening tabs 5230 are received into the locking holes 113, the second fastening tabs 5231 are received into the cutouts 115, and at the same time, the tongue portion 12 is supported on the connection portion 522, the lower row of the inner conductors 40 are disposed in the supporting grooves 120 and the upper row of the inner conductors 40 are disposed in the second receiving grooves 1111, and the braiding layers 42 are disposed on the supporting portion 521, then the upper row of the inner conductors 40 soldered to the second contacts 3, one conductor 40 is connected with a second contact 3, and the lower row of the inner conductors 40 soldered to the first contacts 2, two inner conductors 40 are connected with a power contact 21 and one inner conductor 40 is connected with a signal contact 22, and the braiding layers 42 soldered to the supporting portion 521, then the top shell 51 is assembled to the bottom shell 52 along a vertical direction perpendicular to the mating portion, the tabs 5111 are locked into the holes 5210. The top shell 51 is only shielding outside the tongue portion 12 and the conjunction portion between the cable 4 and the first contacts 2. The top shell 51 is located above the supporting portion 521 of the bottom shell 52, and the cover 7 is molded outside of the back of the insulative housing 1, the conjunction portion of the cable 4 and the first contacts 2 and the second contacts 3 and partial of the cable 4. Thus, the cable assembly 100 is assembled. Specially, the front portion of the side wall 523 of the bottom shell 52 is higher than the upper surface of the housing 1 and exposed out of the cable assembly 100 for making the cable assembly 100 exactly matched to a complementary connector (not shown).

What is claimed is:

1. A cable assembly, comprising:

a plurality of first contacts;

an insulative housing molding outside the first contacts, having an upper surface and a lower surface;

a plurality of second contacts received in the housing;

a flat cable connecting with the first contacts and the second contacts, and the cable comprising a plurality of inner conductors arranged on upper and lower row, the upper row of the inner conductors soldered to the second contacts and the lower row of the inner conductors soldered to the first contacts; and a metallic shell comprising a bottom wall assembled on the lower surface of the housing and a pair of side walls extending upwardly from two sides of the bottom wall, and each side wall defining a lower rear portion not higher than the upper surface of the housing and a higher front portion higher than the upper surface of the housing; wherein the lower surface of the housing is shielded by the bottom wall of the metallic shell and the upper surface of the housing is not shielded by the metallic shell and communicating with an exterior directly along a vertical direction;

wherein the metallic shell defines a supporting portion formed on said rear portion of the bottom wall to contact a plurality of braining layers of the flat cable respectively surrounding the plurality of inner conductors.

2. The cable assembly as claimed in claim 1, wherein said insulative housing comprise a base portion, a tongue portion extending rearward from the base portion, and a plurality of terminal receiving passages and terminal receiving grooves defined in the base portion and extend along a mating direction of the cable assembly.

3. The cable assembly as claimed in claim 2, wherein said insulative housing comprises two locking holes recessed downwardly from two side walls of the upper surface of the base portion and cooperated with two fastening tabs of the metallic shell.

4. The cable assembly as claimed in claim 2, wherein a plurality of supporting grooves are formed in an upper surface of the tongue portion and the supporting grooves are respectively in alignment with the terminal receiving passages along a front-to-back direction.

5. The cable assembly as claimed in claim 4, wherein each second contact comprises a base portion and a second mating portion extending forwardly from the base portion and a tail portion extending rearwardly from the base portion.

6. The cable assembly as claimed in claim 5, wherein each first contact comprises a retention portion, a first mating portion extending upwardly and forwardly from the retention portion, and a tail portion extending backwardly from the retention portion, and the tail portions of the first contacts are supported in the supporting grooves.

7. The cable assembly as claimed in claim 4, wherein a groove is recessed downwardly from the upper surface of the insulative housing to divide the terminal receiving grooves into a front section and a back section.

8. The cable assembly as claimed in claim 7, wherein the cable assembly also comprises a spacer molding outside the second contacts and received in the groove.

9. The cable assembly as claimed in claim 8, wherein the lower row of the inner conductors are disposed in the supporting grooves and the upper row of the inner conductors are disposed in the rear section of the terminal receiving grooves.

10. The cable connector assembly as claimed in claim 1, wherein further comprising a grounding bar cooperated with supporting portion of metallic shell, and the a plurality of braiding layers sandwiched between the grounding bar and the supporting portion of metallic shell.

11. A cable connector assembly comprising:

an insulative housing defining opposite first and second main surfaces, and equipped with a plurality of first terminals embedded therein via an insert molding process and having first contact sections thereof;

a spacer having a plurality of second terminals embedded therein via an insert molding process and having second contact sections thereof, said housing defining a transverse groove exposed in the first main surface to allow said spacer to be mounted therein in a vertical direction perpendicular to said first main surface and a plurality of terminal receiving grooves to receive the corresponding second terminals, respectively;

a metallic shell enclosing the second main surface and having retaining tabs grasping the housing on the first main surface for securing the shell and the housing together;

wherein the shell only veils the second main surface while unveiling the first main surface in the vertical direction where the first contact sections and the second contact sections are located; wherein said shell includes two side walls extending from the second main surface to the first main surface and beyond said first main surface in a vertical direction, and a metallic grounding bar located behind the spacer, assembles and cooperates with the shell to sandwich a cable therebetween.

12. The cable connector assembly as claimed in claim 11, wherein said retaining tabs further fastens the spacer to the housing.

13. The cable connector assembly as claimed in claim 11, wherein the cable having a plurality of wires connected to the corresponding first and second terminals, wherein each of the first terminals is only connected to one wire while someone of the second terminals is connected to the two wires.

14. The cable connector assembly as claimed in claim 11, wherein the first contacting sections are immoveable while the second contacting sections of are up and down moveable and located behind the first contacting sections.

15. The cable connector assembly as claimed in claim 11, wherein said terminal receiving grooves are configured to allow the second terminals to be mounted therein in the vertical direction.

* * * * *